United States Patent [19]

Inamoto

[11] Patent Number: 4,640,606

[45] Date of Patent: Feb. 3, 1987

[54] CORONA DISCHARGER FOR SEPARATING COPY PAPER FROM PHOTORECEPTOR IN ELECTROPHOTOGRAPHIC COPYING MACHINE

[75] Inventor: Kiyoshi Inamoto, Sakai, Japan

[73] Assignee: Sharp Kabushiki Kaisha, Osaka, Japan

[21] Appl. No.: 577,800

[22] Filed: Feb. 7, 1984

[30] Foreign Application Priority Data

Feb. 15, 1983 [JP] Japan ..... 58-24309

[51] Int. Cl.[4] ..... G03G 15/14

[52] U.S. Cl. ..... 355/14 TR; 355/3 SH; 355/14 SH

[58] Field of Search ..... 355/3 R, 3 TR, 3 SH, 355/14 TR, 14 SH

[56] References Cited

U.S. PATENT DOCUMENTS

| | | | |
|---|---|---|---|
| 3,575,502 | 4/1971 | Eppe | 355/3 R |
| 4,277,162 | 7/1981 | Kasahara et al. | 355/3 R X |
| 4,378,153 | 3/1983 | Nishimura et al. | 355/3 R |
| 4,536,082 | 8/1985 | Motohashi et al. | 355/3 SH |

*Primary Examiner*—Fred L. Braun

*Attorney, Agent, or Firm*—Birch, Stewart, Kolasch & Birch

[57] ABSTRACT

An electrophotographic copying machine includes a photoreceptor for forming a latent image of a copy document, a transfer corona charger for transferring the latent image onto a copy document, a separation corona discharger for removing charges from the copy paper, and aid in the separation of the copy paper from the latent image. The corona discharge output of the separation corona discharger is adjustably changed depending on an amount of light reflected by the copy document to more effectively provide for the separation process.

5 Claims, 3 Drawing Figures

CORONA DISCHARGER FOR SEPARATING COPY PAPER FROM PHOTORECEPTOR IN ELECTROPHOTOGRAPHIC COPYING MACHINE

BACKGROUND OF THE INVENTION

The present invention relates to an electrophotographic copying machine and, more particularly, to a corona discharger for separating a copy paper from a photoreceptor in an electrophotographic copying machine.

An electrophotographic copying machine produces onto a photoreceptor an electrostatic latent image corresponding to a pattern image on a document such as a manuscript or book to be copied. Toner particles are electrostatically adhered to the latent image, so that the latent image becomes visible as a toner image. The toner image on the photoreceptor is transferred onto a copy paper via a transference charger.

To electrostatically transfer the toner image to the copy paper, conventionally, a corona discharge in a polarity opposed to the polarity of the toner particles placed on the photoreceptor is applied to the copy paper from the back surface of the copy paper on which no toner image is to be transferred. Since the copy paper is charged by the corona discharge, the copy paper is attracted by the photoreceptor on account of Coulomb force. Means must be provided for separating the copy paper from the photoreceptor.

By way of example, such a means may comprise a corona discharger provided for generating a corona discharge to separate the copy paper by removing the excess charges from the copy paper, thereby weakening the contact force between the photoreceptor and the copy paper. Depending on the stiffness and the weight of the copy paper, the copy paper can be separated from the photoreceptor. This is called a "corona separation method" herein.

In the conventional corona separation method, a predetermined constant voltage is applied to the separation corona discharger. The constant voltage is selected so that the separation corona discharger can output a common corona discharge voltage capable of separating all copy papers from the photoreceptor regardless of whether the copied images are all black, all white or a combination.

However, the range of such a common corona discharge voltage for separating the copied paper having any types of images from the photoreceptor is so narrow that the paper separation may fail when the surrounding conditions, the kind of the copy paper and the like, are changed so that the common corona discharge voltage is deviated from the paper separation range.

SUMMARY OF THE INVENTION

Accordingly, it is an object of the present invention to provide an improved electrophotographic copying machine for separating a copy paper from a photoreceptor.

It is another object of the present invention to provide an improved corona discharger in an electrophotographic copying machine for separating a copy paper from a photoreceptor.

It is a further object of the present invention to provide an improved corona discharger in an electrophotographic copying machine for separating a copy paper from a photoreceptor, in which the corona discharger can change a discharge voltage depending on brightness of an image to be copied.

Briefly described, in accordance with the present invention, an electrophotographic copying machine comprises a photoreceptor means for receiving light reflected by a copy document and forming a latent image corresponding to the light pattern of the copy document, a corona transfer means for transferring the latent image onto a copy paper with a corona discharge while the copy paper is close to the photoreceptor, a separation corona discharger means for causing a corona discharge to the copy paper and removing charges from the copy paper which are added to the copy paper during the corona transfer, so that the copy paper is electrostatically separated from the photoreceptor. An amount of the corona discharge voltage outputted by the separation corona discharger means is changed depending upon an amount of light reflected by the copy document.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
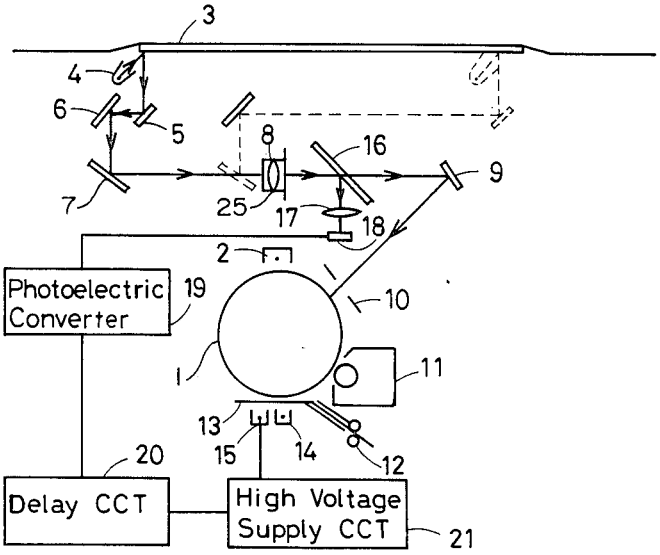
FIG. 1 is a side view of an electrophotographic copying machine according to the present invention.

FIG. 1 shows a side view of an electrophotographic copying machine according to the present invention.

Referring to FIG. 1, the copying machine comprises a photoreceptor 1 disposed around a rotational drum. A charger 2 is provided for uniformly charging the photoreceptor 1. A document table 3 is provided for carrying a document to be copied. A light exposing device 4 is provided for exposing light toward the document mounted on the document table 3 as the document table 3 is reciprocated in accordance with the rotation of the drum and the photoreceptor 1, so that the reflected light beams are incident onto the photoreceptor 1 through an optical system to form an electrostatic latent image on the photoreceptor 1. The optical system includes mirrors 5, 6, 7 and 9, a lens 8, and a slit 10. A developing device 11 is provided for developing the latent image with toner particles to form a toner image. A transfer corona discharger 14 is provided for electrostatically transferring the toner image onto a copy paper 13 when the copy paper 13 comes close to the surface of the photoreceptor 1. The transfer corona discharger 14 is positioned behind the copy paper 13 which is close to the surface of the photoreceptor 1. The copy paper 13 is introduced into the copier from a number of copy papers as stored within a cassette by paper pick-up rollers. The paper feeding rollers 12 are provided for feeding the picked-up copy paper 13 into the transfer corona discharger 14 in synchronization with the rotation of the photoreceptor 1.

According to the present invention, a separation corona discharger 15 is provided for electrostatically separating the copy paper 13 from the photoreceptor 1. The separation corona discharger 15 is positioned at the side of the transfer corona discharger 14. Responsive to the application of an AC power source, the separation corona discharger 15 causes a corona discharge so that charges can be removed from the copy paper. If necessary, a suitable DC voltage may be added to supplement the AC voltage.

With the help of the separation corona discharger 15, the copy paper 13 can be easily separated from the photoreceptor 1 since the attraction of the copy paper 13 to the photoreceptor 1 becomes weak after the charges are removed. The separated copy paper 13 is forwarded into a pair of fixing rollers which are provided for pressing the toner image onto the copy paper 13 to fix the toner image thereon (not shown in drawings).

A charge-removing charger may be provided for charging the photoreceptor 1 in a polarity opposed to the polarity of the remaining charges on the photoreceptor 1 to remove the charges from the photoreceptor 1. A lighting device may be provided for lighting the photoreceptor 1 to remove the charges from the photoreceptor 1.

According to the present invention, an AC voltage to be applied to the separation corona discharger 15 is adjusted depending upon the amount of light reflected from the document.

Figure 2:
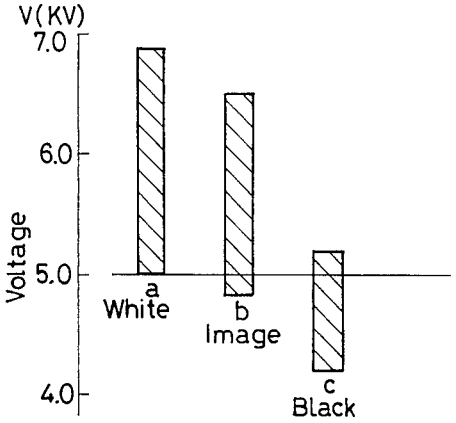
FIG. 2 shows a graph showing the relation between image brightness and a corona discharge voltage.

FIG. 2 presents a graph showing the relation between image brightness of the copied document and corresponding corona discharge output voltages. Each of the corona discharge outputs, as shadowed, is applied to the photoreceptor 1 to remove the copy paper 13 from the drum, the copy paper having various degrees of brightness including all white "a", a specific image "b", and all black "c".

FIG. 2 shows that when the document to be copied is entirely white, a great amount of charges are present on the copy paper 13 during the corona transfer, the corresponding voltage to be applied to the separation corona discharger 15 must be made sufficiently high to remove the great amount of charges from the copy paper 13. Therefore, a large corona discharge output must be provided by the separation corona discharger 15. When the document to be copied is entirely black, a smaller amount of charges are added onto the copy paper 13 during the corona transfer. Therefore, the corresponding voltage to be applied to the separation corona discharger 15 should be made sufficiently low to remove such a small amount of charges from the copy paper 13. A lower corona discharge output should be provided by the separation corona discharger 15. To enable such a correspondence between paper reflection and voltage, the light exposure amount is detected so that the voltage to be applied to the separation corona discharger 15 may be set to control the corona discharge output. As larger amounts of light are reflected by the document, it is detected as to whether the document is more nearly white paper.

To detect the reflected light amount, as shown in FIG. 1, a half-mirror 16 is interposed between the lens 8 and the reflection mirror 9, so that some of the light can be gathered via a lens 17 to a light detection element 18 for detecting the light amount. Preferably, the half-mirror 16 is positioned near the lens 8 to enable the mirror 16 to be relatively small. After a signal from the light detection element 18 is amplified by a photoelectric converter 19, the signal is inputted into a high voltage supply circuit 21 via a delay circuit 20. The high voltage supply circuit 21 is provided for controlling the voltage supply the separation corona discharger 15. The delay circuit 20 is provided for generating delayed output by a time proportionate to the rotation of the photoreceptor 1 carrying the latent image so that the corresponding latent image passes the separation corona discharger 15 at the appropriate time for the voltage to be applied.

Responsive to the amount of the light received by the light detecting element 18, the high voltage supply circuit 21 inputs a supply voltage to the separation corona discharger 15. When entire white paper is used as the document, the light detection element 18 receives a great amount of light so that a high AC voltage is applied to a corona wire of the separation corona discharger 15. It is preferable that the high voltage supply circuit 21 changes its supply voltage depending upon the output of the light detection element 18. It may be possible that the high voltage supply circuit 21 switches its predetermined constant output voltage by comparing a first output of the light detection element 18 with a second output of the element 18 to detect whether to exceed a predetermined threshold level.

When the output of the high voltage supply circuit 21 is an AC voltage supplemented by a DC voltage, only the AC voltage components are adjustably charged with the DC compoments being kept constant. It may be further possible that both compoments could be adjustably changed.

Thus, when an entirely black paper is to be copied, the light detection element 18 receives a small light amount reflected from the document. When the portion of the photoreceptor 1 carrying the latent image reaches the position of the separation corona discharger 15, the voltage corresponding to the light amount is applied to the discharge wire of the discharger 15 by the high voltage supply circuit 21. The most suitable corona discharge is caused to remove the charges from the copy paper 13 and thereby provides for the easy separation of the copy paper 13 from the photoreceptor 1.

As the system of FIG. 1 detects the amount of light reflected, all the light passing the lens 8 can be measured. Since the copying machine is of the type which generates slit light toward the document, the document is exposed to the light in a unit of vertical stripe extended from the side near to the operator to the side far from the operator. Therefore, the amount of detected light is proportional to a mean value of the image density vertically extended from the nearest side to the farthest side. Therefore, a suitable total voltage is applied to the separation corona discharger 15 regarding the entire surface of the document.

The light amount detection means should not be limited to the type as shown in FIG. 1. The light detecting element 18 is positioned at a point where the light passes through the lens 8 such that an element 25 overlays the lens 8. In such a case, since the element 25 is small, the formation of the latent image may not be prevented.

Figure 3:
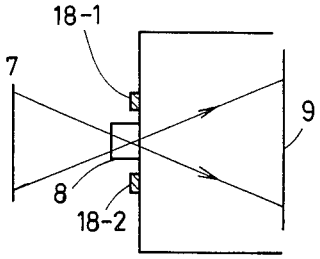
FIG. 3 is a side view of a light detection element that may be included within the copying machine according to the present invention.

FIG. 3 shows another example of a light detection element. In FIG. 3, a pair of light detection elements 18-1 and 18-2 are positioned at both sides of the lens 8 such that the reflected light is directly detected without use of the lens 8. The pair of elements 18-1 and 18-2 permits the light sensitivity to be uniform regardless of the image positions located within the document.

It should be noted that in lieu of the optical system including the mirrors 5, 6, 7 and 9 and the lens 8, a lens array including a great number of lens pieces can be used.

While only certain embodiments of the present invention have been described, it will be apparent to those skilled in the art that various changes and modifications may be made therein without departing from the sprit and scope of the present invention as claimed.

What is claimed is:

1. An electrophotographic copying machine comprising:

photoreceptor means for forming a latent image thereon corresponding to an image of a document based on light reflected by said document;

transfer means for transferring said latent image onto a copy paper while said copy paper is close to the photoreceptor; and separation corona discharger means actuated by a selected voltage for causing a corona discharge to said copy paper so that said copy paper is permitted to electrostatically separate from said photoreceptor;

photodetector means for sensing the amount of light reflected from said document; and control means responsive to the photodetector means for applying the selected voltage to said separation corona discharge means, the selected voltage being proportional to the amount of light reflected from said document.

2. The machine of claim 1, wherein said separation corona discharger means is an AC corona discharge.

3. The machine of claim 1, wherein said photodetector means comprises a half-mirror for monitoring the amount of the reflected light, a photosensitive element responsive to light reflected from said half-mirror for generating an electric current, and said control means includes a photoelectric converter responsive to said photosensitive element for amplifying the electrical signal, a delay circuit responsive to said converter for delaying said amplified signal so as to synchronize said amplified signal with the arrival of said latent image, and a high voltage supply circuit responsive to said delay circuit for supplying said selected voltage to said separation corona discharger means.

4. An electrophotographic copying machine comprising:

a photoreceptor disposed around a rotational drum;

means for forming an electrostatic latent image on said photoreceptor, said means including a light exposing device for directing incident light toward a copy document on a copy document table and an optical system for directing reflected light from said copy document toward said photoreceptor;

a developing device for developing said electrostatic latent image with toner particles to form a toner image;

corona transfer means for electrostatically transferring said toner image onto a copy paper;

light detection means for detecting an amount of reflected light passing through said optical system, said light detection means including a photosensitive element, a light gathering lens, and a half-mirror so that a portion of said reflected light is directed toward said photosensitive element by said half-mirror through said light gathering lens and a portion of said reflected light is directed through said half-mirror toward said photoreceptor via a reflection mirror;

separation corona discharge means for electrostatically releasing said copy paper from said photoreceptor, said separation corona discharge means being actuated by a selected variable voltage received from said photosensitive element; and control means, responsive to said photosensitive element, for applying said selected variable voltage to said separation corona discharge means, the selected variable voltage being proportional to the amount of said reflected light.

5. A copy machine according to claim 4, wherein said photosensitive element generates a signal voltage received, and said control means includes a photoelectric converter, responsive to said signal generated by said photosensitive element, for amplifying said signal, a delay circuit responsive to said photoelectric converter for delaying said amplified signal by a predetermined length of time to synchronize said amplified signal with the arrival of said electrostatic latent image on said photoreceptor, and a high voltage supply circuit responsive to said delay circuit for supplying said selected variable voltage to said separation corona discharge means.

* * * * *